US007748513B2

(12) United States Patent
Atsuta et al.

(10) Patent No.: US 7,748,513 B2
(45) Date of Patent: Jul. 6, 2010

(54) VENDING MACHINE

(75) Inventors: Junichi Atsuta, Nagareyama (JP); Tomochika Fukumoto, Kawasaki (JP)

(73) Assignee: T-Arts Company, Ltd., Tokyo (JP)

( * ) Notice: Subject to any disclaimer, the term of this patent is extended or adjusted under 35 U.S.C. 154(b) by 4 days.

(21) Appl. No.: 11/792,383

(22) PCT Filed: Dec. 21, 2005

(86) PCT No.: PCT/JP2005/023487

§ 371 (c)(1),
(2), (4) Date: Jun. 6, 2007

(87) PCT Pub. No.: WO2006/068177

PCT Pub. Date: Jun. 29, 2006

(65) Prior Publication Data

US 2008/0017474 A1 Jan. 24, 2008

(30) Foreign Application Priority Data

Dec. 21, 2004 (JP) ..... 2004-369547

(51) Int. Cl.
*G07F 9/06* (2006.01)
*G07F 9/10* (2006.01)

(52) U.S. Cl. ..... 194/350

(58) Field of Classification Search ..... 194/350; 221/154, 174, 197, 281, 282, 285–288, 312 R
See application file for complete search history.

(56) References Cited

U.S. PATENT DOCUMENTS 3,804,294 A * 4/1974 Householder ..... 221/154
4,037,700 A * 7/1977 Heraty ..... 194/350
5,091,713 A 2/1992 Horne et al.
5,125,492 A 6/1992 Treleaven et al.
5,131,519 A 7/1992 Ra
5,555,965 A 9/1996 Mishina
5,794,816 A * 8/1998 Pliler et al. ..... 221/203
5,909,795 A 6/1999 Porco et al.
6,382,387 B1 5/2002 Morad et al.
6,857,710 B2 * 2/2005 Bolen ..... 312/35
7,020,680 B2 3/2006 Defosse (Continued)

FOREIGN PATENT DOCUMENTS

CA 2 477 2031 8/2003

(Continued)

OTHER PUBLICATIONS

Extended European Search Report dated Feb. 15, 2008 issued in corresponding European Application No. 05820133.6.

(Continued)

*Primary Examiner*—Patrick Mackey
*Assistant Examiner*—Mark Beauchaine
(74) *Attorney, Agent, or Firm*—Staas & Halsey LLP

(57) ABSTRACT

A vending machine for discharging merchandises by inserting a coin to operate a discharge merchandise retention member by a handle. The vending machine includes: a notch provided at a front face of a body to open upward, and a control panel attached with the notch in a detachable manner, the control panel including the handle and a coin sorting unit.

4 Claims, 15 Drawing Sheets

U.S. PATENT DOCUMENTS

| | | | | |
|---|---|---|---|---|
| 7,377,065 | B2 * | 5/2008 | Myatt et al. | 40/611.01 |
| 2001/0010315 | A1 | 8/2001 | Tomioka | |
| 2003/0052577 | A1 | 3/2003 | Bolen | |
| 2005/0173222 | A1 | 8/2005 | Schwarzli et al. | |
| 2006/0200271 | A1 | 9/2006 | Porco | |

FOREIGN PATENT DOCUMENTS

| | | |
|---|---|---|
| DE | 19729845 | 1/1998 |
| EP | 0823696 | 2/1998 |
| GB | 2 297 641 | 8/1996 |
| JP | 55-100280 | 7/1980 |
| JP | 56-47891 | 4/1981 |
| JP | 61-32998 | 2/1986 |
| JP | 61-109190 | 5/1986 |
| JP | 62-9878 | 1/1987 |
| JP | 25215542 | 5/1996 |
| JP | 10-105813 | 4/1998 |
| JP | 10-208119 | 8/1998 |
| JP | 2003-123135 | 4/2003 |
| JP | 2004-288119 | 10/2004 |
| JP | 2004-334911 | 11/2004 |
| WO | WO 03/015039 | 2/2003 |
| WO | 03/071496 | 8/2003 |

OTHER PUBLICATIONS

International Search Report of the International Published Application No. PCT/JP2005/023487 (mailed Mar. 20, 2006).

International Preliminary Report on Patentability dated Jun. 26, 2007 (in English) (4 pages).

International Search Report mailed Apr. 4, 2006 for International Application PCT/JP2005/023489.

Publication Data Regarding EP 1490844.

Extended European Search Report dated Sep. 29, 2008 for European Application No. 05820141.9 corresponding to PCT/JP2005 023484.

International Search Report mailed Apr. 18, 2006 for International Application No. PCT/JP2005/023484.

International Search Report mailed Mar. 20, 2006 for International Application No. PCT/JP2005 023487.

International Preliminary Report on Patentability issued Jun. 26, 2007 for International Application No. PCT/JP2005 023487.

Extended European Search Report dated Feb. 15, 2008 for European Application No. 05820133.6 corresponding to PCT/JP2005 023487.

International Preliminary Report on Patentability issued Jun. 26, 2007 for International Application No. PCT/JP2005 023489.

International Preliminary Report on Patentability issued Jun. 26, 2007 for International Application No. PCT/JP2005 023484.

Patent Abstracts of Japan, Publication No. 3-269790[2], published Dec. 2, 1991.

U.S. Appl. No. 11/793,225, filed Jun. 18, 2007, Atsuta et al., Yujin Company Ltd.

U.S. Appl. No. 11/793,215, filed Jun. 18, 2007, Atsuta et al., Yujin Company Ltd.

* cited by examiner

VENDING MACHINE

CROSS-REFERENCE TO RELATED APPLICATIONS

This application claims the benefit under U.S.C. Section 371, of International Application No. PCT/JP2005/023487, filed Dec. 21, 2005, and Japanese Application No. 2004-369547, filed Dec. 21, 2004, the contents of which are incorporated herein by reference.

TECHNICAL FIELD

The present invention relates to a vending machine. In particular, the present invention relates to a structure for providing a control panel.

BACKGROUND OF THE INVENTION

A merchandise discharge apparatus has been known in which a merchandise filled in a capsule (hereinafter referred to as capsule merchandise) is stored in a box and the capsule merchandise is discharged when a predetermined coin is inserted to a coin insertion slot and a handle is rotated.

See, e.g., Japanese Patent Application Publication Laid-open No. 2003-123135 (FIG. 3).

SUMMARY OF THE INVENTION

In the vending machine of Japanese Reference No. 2003-123135, a back face of a front panel includes a coin sorting unit. This causes a troublesome operation to detach the coin sorting unit for the maintenance of the coin sorting unit for example.

In view of the above problem, the present invention has been made. It is an objective of the present invention to provide a vending machine that provides an easy maintenance operation of a coin sorting unit or the like.

According to a vending machine of a first embodiment, a vending machine in which a coin is inserted to cause an operation power is given to a handle to operate a discharge merchandise retention member to discharge a merchandise, includes: a notch which is provided at a front face of a box body and which opens upward, a control panel which is attached with the notch in a detachable manner, the control panel including the handle and a coin sorting unit.

According to a vending machine of a second embodiment, in the vending machine of the first embodiment, a coin collection box is provided at the rear side of the notch of the box body and the coin collection box is externally covered by covering a front face of the coin collection box with the control panel while the control panel is attached to the notch.

According to a vending machine of a third embodiment, in the vending machine of the first or second embodiment a side face of the notch has one of a convex groove or a concave groove, a side face of the control panel has the other of a convex groove or a concave groove, and the control panel is attached to the box body by sliding a side face of the control panel with a side face of the notch from the upper side of the notch to engage the convex grove with the concave groove.

According to a vending machine of a fourth embodiment, in the vending machine of the third embodiment, a merchandise filling opening is provided to the upper side of the notch of the box body, a cover is attached with the merchandise filling opening in a detachable manner, the control panel is prevented from moving upward when the cover is attached, and the control panel is allowed to move upward when the cover is detached.

According to a vending machine of a fifth embodiment, in the vending machine of the fourth embodiment, one of the control panel and the body box has a spring, the spring allows descent of the control panel to stop at least at a position where the a front face of the coin collection box remains exposed, and the control panel and the body box have a locking section that clamps the control panel in a completely depressed state against a biasing force of the spring.

According to the first embodiment, the front panel including the coin sorting unit can be detached from the box, thus realizing an easy maintenance.

According to the second embodiment, the coin collection box completely covered with the control panel provides secure safety and eliminates the need for a lock for a coin collection box, thus providing a proportional cost reduction.

According to the third embodiment, the control panel that can be slid to be attached to the box body can provide an easy attachment and can allow the control panel to be attached to the box body in a robust manner.

According to the fourth embodiment, the cover blocks the upward movement of the control panel and thus eliminates a need for a special unit for locking the control panel, thus providing a proportional cost reduction.

According to the fifth embodiment, the control panel is stopped halfway without being dropped to the lower end of the notch. Thus, a finger is prevented from being caught by the lower end of the control panel for example. Furthermore, the coin collection box can be taken out easily without being obstructed by the control panel.

BRIEF DESCRIPTION OF THE DRAWINGS

[FIG. 11B] This is a view illustrating the cover for opening or closing the merchandise discharge opening being slightly pushed in.

[FIG. 11C] This is a view illustrating the cover for opening or closing the merchandise discharge opening being pushed in.

DESCRIPTION OF THE EMBODIMENT

Figure 1:
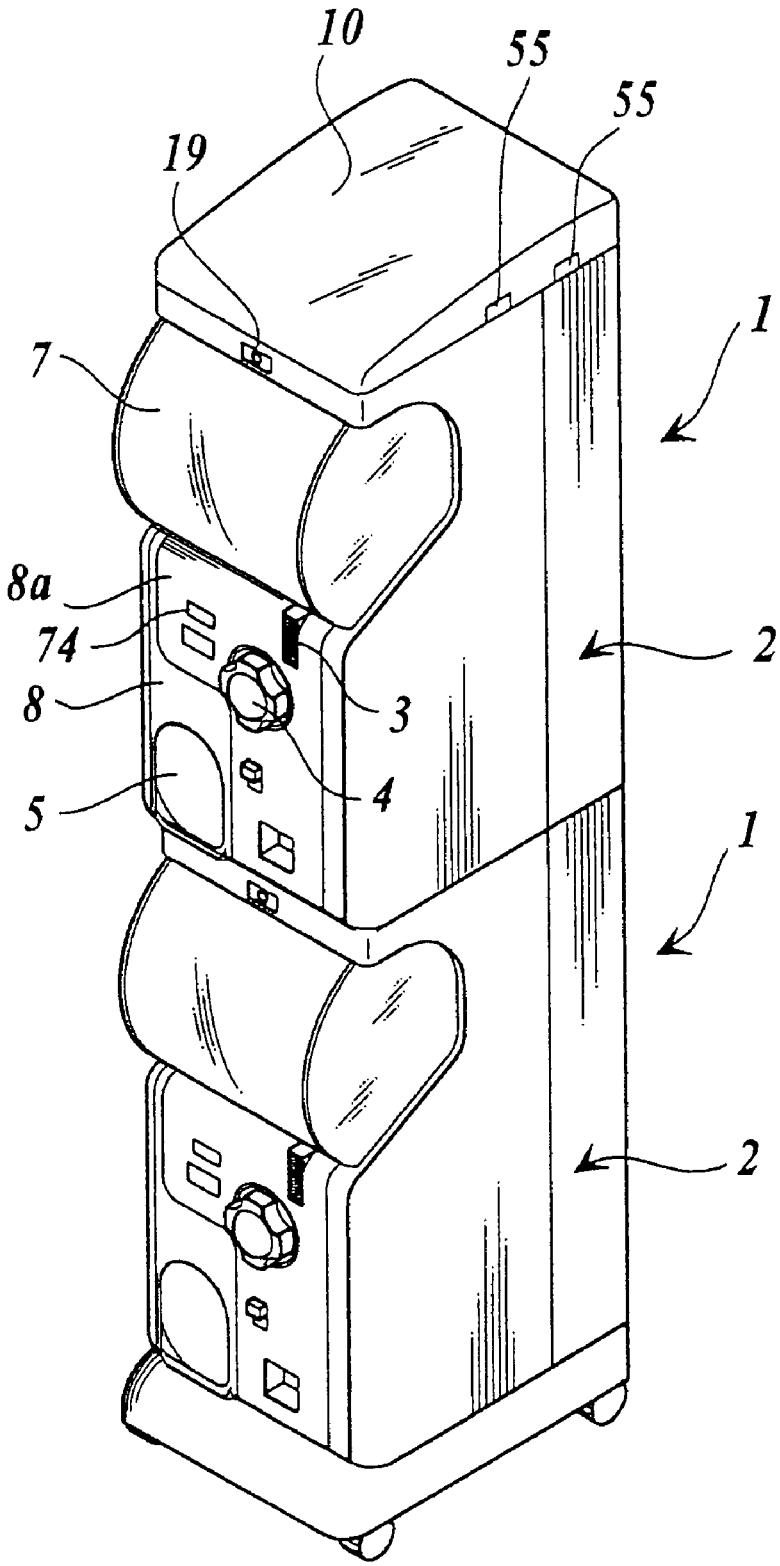
[FIG. 1] This is a perspective view illustrating two vending machines according to the present invention stacked on each other.

In a vending machine 1 of FIG. 1, a merchandise A filled in a capsule (hereinafter referred to as capsule merchandise A) for example is stored in a box 2. See FIGS. 11A-11C. When a person inserts a predetermined coin to a coin insertion slot 3 on a front face of the box 2 and then subsequently rotates a handle 4, the capsule merchandise A in the box 2 is discharged from a discharge opening 5 provided at the front face of the box 2. In the vending machine 1 shown in FIG. 1, two boxes 2 are stacked on each other and the bottom of the lower box 2 is attached to a stand including wheels and the upper box 2 has thereon a top panel 10.

Figure 2:
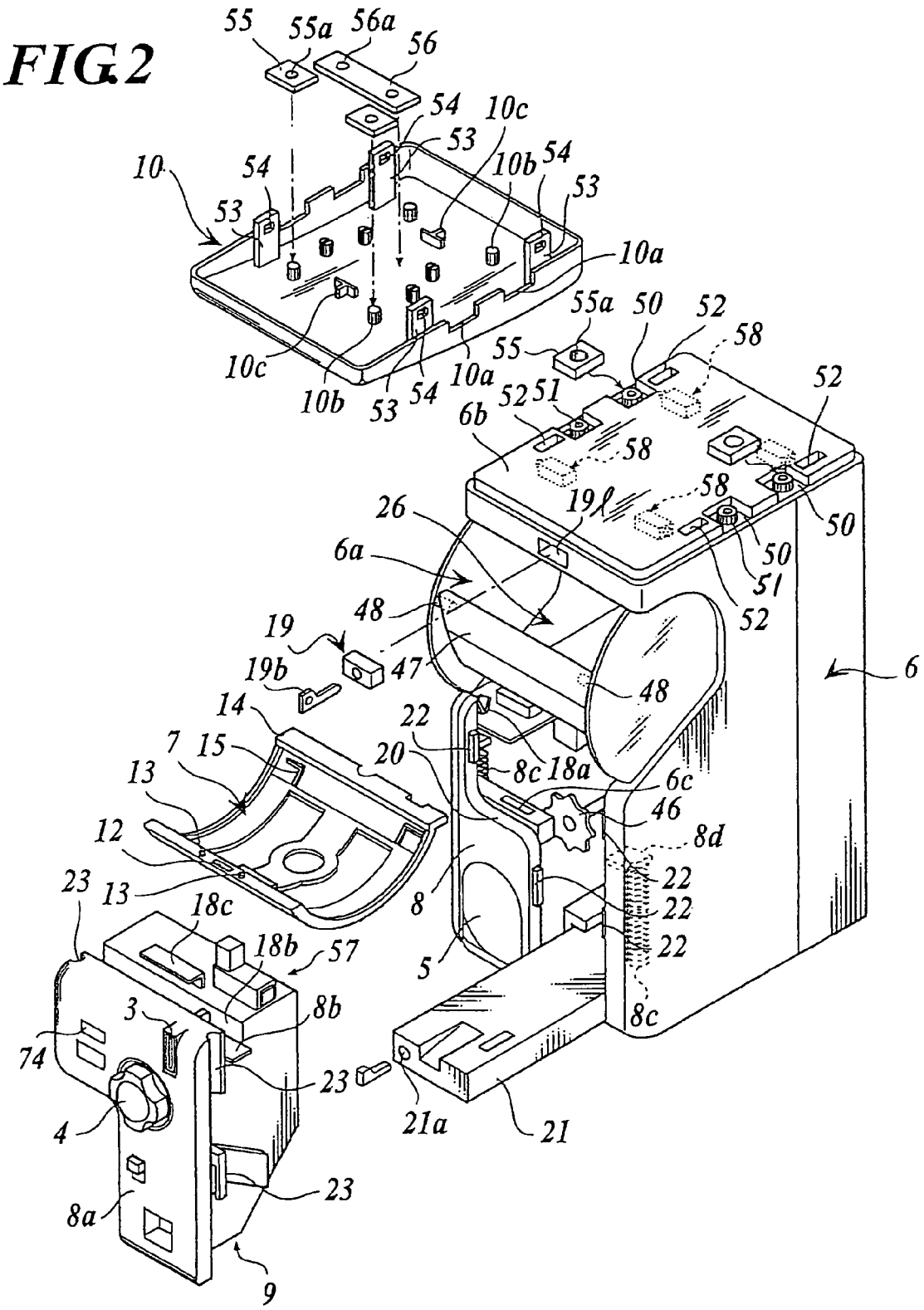
[FIG. 2] This is an exploded perspective view illustrating a vending machine according to the present invention.

As shown in FIG. 2, the box 2 includes: a box body 6; a cover 7 for covering a merchandise filling opening 6*a* of a front face of the box body 6; a control panel 8*a* that includes a part of a front panel 8 provided at the lower part of the front face of the box body 6 and that includes a coin sorting unit 9 at the back face; and the top panel 10 covering the upper face of the box body 6.

Figure 3:
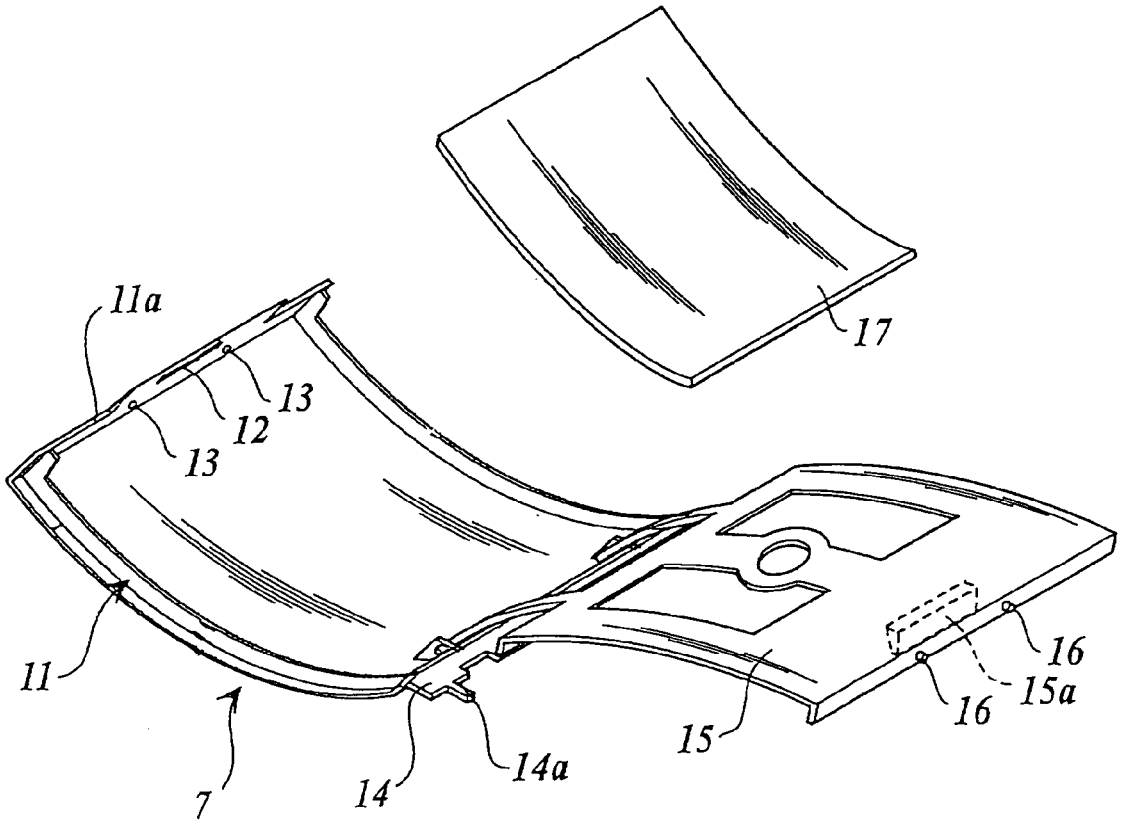
[FIG. 3] This is a perspective view illustrating a retainer plate attached to a cover so that the retainer plate is opened.

The cover 7 is made of transparent resin and is formed, as shown in FIG. 3, to have a concave curved shape to the front side. Each side of the cover 7 has a wall 11 protruding on the rear side of the cover. At the center in a width direction of the upper end wall 11*a* of the cover 7, a long hole 12 is provided in a width direction of the box 2. The upper end wall 11*a* of the cover 7 includes small holes 13 formed to sandwich the long hole 12. The inner face of the cover 7 has a retainer plate 15 that is also formed to have a curved shape as in the cover 7. The retainer plate 15 is attached to a base section of the cover 7 (lower end of curved section) in a rotatable manner. The upper end edge of the retainer plate 15 has pins 16 protruding to the upper side. At the center immediately below the upper end edge of the retainer plate 15, a pull 15*a* protruding to the rear side is provided. The retainer plate 15 and the cover 7 have therebetween a display section 17 (e.g., pop) and the pins 16 are engaged with the small holes 13 of the cover 7 so as to be locked along the cover 7. When the display section 17 is detached, one hand can grab the cover 7 and the other hand can pull the pull 15*a* to separate a free end of the retainer plate 15 from the cover 7, thereby detaching the display section 17. It is noted that the lower end of the curved section of the cover 7 has a bending part 14 extending to the lower side. The lower edge of the bending part 14 has protrusions 14*a* at the left and right sides.

Figure 4:
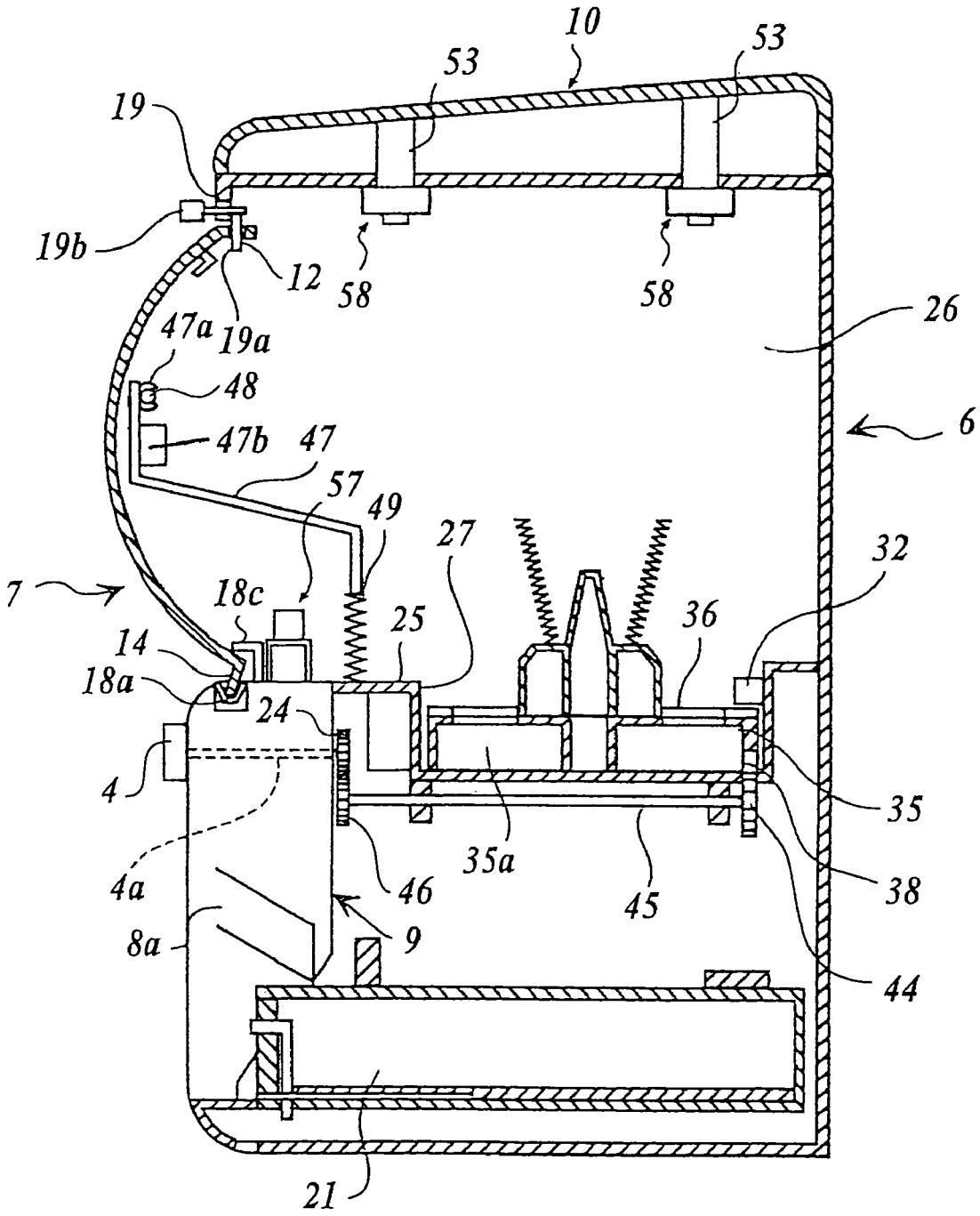
[FIG. 4] This is a conceptual cross sectional view of a vending machine.

Next, a structure for attaching the cover 7 will be described. Both side walls sandwiching the merchandise filling opening 6*a* of the box body 6 are provided by a transparent plate so that the capsule merchandise A in the vending machine can be visually recognized from the lateral side of outside in an oblique direction. The inner faces of the both side walls of the box body 6 have, as shown in FIG. 4, a V-like concave part 18*a* having an opening to the upper side. This concave part 18*a* is used for the positioning of the cover 7. Specifically, the cover 7 can be appropriately positioned by inserting, while the cover 7 is being lowered to the front side of the front face (while the inner face of the cover 7 is facing upward), the bending part 14 of the cover 7 into the concave part 18*a* to cause the front side part of the bending part l4 to abut the front-side wall of the concave part 18*a*. In this status, when the cover 7 is raised around the lower edge of the bending part l4 of the cover 7, the rear part of the bending part 14 of the cover 7 abuts a wall at the rear side of the concave part 18*a*. This position is a position at which the cover 7 is closed. The upper face of the control panel 8*a* includes a long groove 18*b* extending in the width direction. This long groove 18*b* is a part that receives the bending part of the cover 7 and that is shaped so that the cover 7 can be raised or lowered. The upper face of the control panel 8*a* includes a locking piece 18*c* provided at the center in the width direction. This locking piece 18*c* prevents an upward movement of the closed cover 7. Specifically, when the cover 7 is raised, the lower end of the curved section is inserted to the lower side of the locking piece 18*c* to prevent the upward movement of the closed cover 7. In order to effectively prevent the upward movement of this cover 7, the lower end of the curved section of the cover 7 preferably has a curvature different from those of the other parts of the curved section so that the lower end of the bending part of the cover 7 is appropriately locked by the locking piece 18*c*.

It is noted that, when the cover 7 is closed, the protrusions 14*a* formed on the bending part l4 of the cover 7 are inserted in the lower side of the upper wall of the control panel 8*a*. As a result, the cover 7 is locked to the control panel 8*a*. Furthermore, the cover 7 also preferably has a handle at the front face so that the cover 7 can be detached from the box body 6 by being pulled down easily with the handle.

As shown in FIG. 2, the box body 6 is structured so that the merchandise filling opening 6*a* has thereon a lock 19. As shown in FIG. 5, the lock 19 is composed of a lock body 19*a* and a key 19*b*. Among them, the lock body 19*a* is composed of a cylinder section 19*c*, a rotor part 19*d*, and locking pieces 19*e* and 19*f*. This lock body 19*a* is retained by an attachment block 19*g* in a detachable manner. It is noted that, although the locking piece 19*e* and the locking piece 19*f* are integrated in this embodiment, the structure is not particularly limited.

Next, a method to attach the lock body 19*a* to the attachment block 19*g* will be described. When the lock body 19*a* is attached to the attachment block 19*g*, the locking pieces 19*e* and 19*f* are detached from the lock body 19*a* in advance. Then, the lock body 19*a* in this status is pushed into a concave part 19*h* in front of the attachment block 19*g*. Then, a lock part (not shown) at the outer periphery of the cylinder section 19*c* abuts the bottom part of the concave part 19*h*, thus preventing the lock body 19*a* from being pushed further. The bottom of the concave part 19*h* on the other hand includes a penetration hole having an opening to at the rear side of the attachment block 19*g*. Thus, when the lock body 19*a* is in this state, a part of the cylinder section 19*c* protrudes from the rear side of the attachment block 19*a*. This protruded section includes a male screw section 19*i* that is screwed with a nut 19*j*. Finally, the locking pieces 19*e* and 19*f* are screwed to the rear end of the rotor part 19*d* from the rear side of the protruded section.

As described above, the lock body 19*a* is attached to the attachment block 19*g*. It is noted that the lock body 19*a* can be detached from the attachment block 19*g* in an opposite order of that of the above operation.

Next, a structure for attaching the attachment block 19*g* will be described. The attachment block 19*g* is provided with nail pieces 19*k* and 19*k* at both sides. The box body 6 on the other hand has a concave part 19*l* that can be engaged with the attachment block 19*g*. The bottom part of the concave part 19*l* includes holes 19*m* and 19*n*.

Figure 5A:
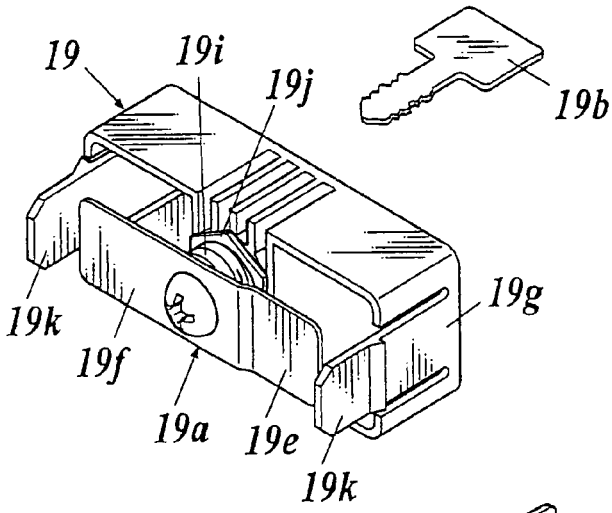
[FIG. 5A] This is a perspective view illustrating a lock body and a key for locking the cover to the box body.
Figure 5B:
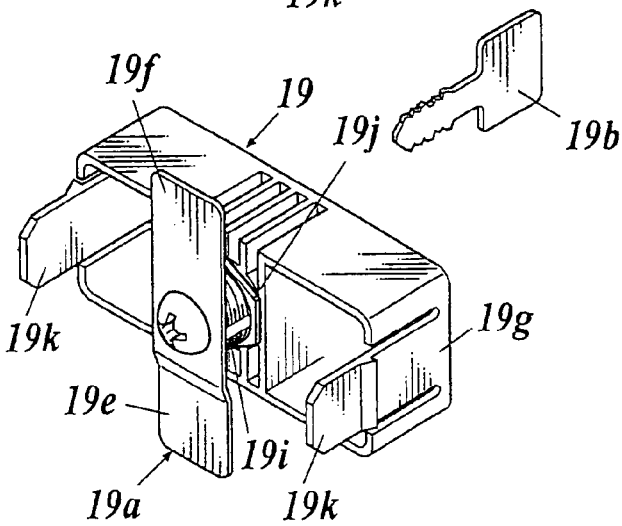
[FIG. 5B] This is a perspective view illustrating the lock body and the key while the cover is being locked to the box body.
Figure 5C:
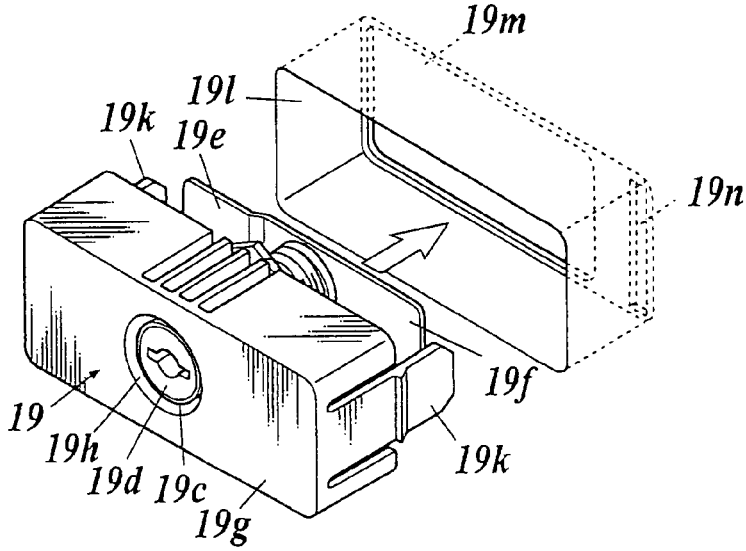
[FIG. 5C] This is a perspective view illustrating a structure for attaching the lock body to the box body.

In order to attach the attachment block 19*g* attached with the lock body 19*a* to the box body 6, the locking pieces 19*e* and 19*f* are placed in the lateral direction in advance as shown in FIG. 5(A). Next, as shown in FIG. 5(C), the attachment block 19*g* is engaged into the concave part 19*l* by inserting the locking pieces 19*e* and 19*f* first. In this case, the locking pieces 19*e* and 19*f* and a tip end of one of the nail pieces 19*k* pass through the hole 19*m*. A tip end of the other nail piece 19*k* on the other hand passes through the hole 19*n*. Then, protrusions provided at the outer side of the nail pieces 19*k*, 19*k* are locked to the back side of the concave part 19*l* by the elasticity of the nail pieces 19*k*, 19*k*.

In the manner as described above, the attachment block 19*g* is attached to the box body 6. It is noted that the attachment block 19*g* can be detached from the box body 6 by using a hand to push out the attachment block 19*g* from the inner side of the box body 6 while the locking pieces 19*e* and 19*f* being placed in the lateral direction.

Next, a structure for locking the cover 7 by this lock 19 will be described. While the locking pieces 19*e* and 19*f* of the lock body 19*a* being placed in the lateral direction, the cover 7 is not locked to the box body 6. When the locking pieces 19*e* and 19*f* are rotated and placed in the longitudinal direction by the key 19*b* on the other hand, the locking piece 19*e* is inserted into the long hole 12 of the cover 7 and the other locking piece 19*f* is inserted into a long hole (not shown) of the upper wall 6*b* of the box body 6. As a result, the cover 7 is locked to the box body 6 and at the same time the attachment block 19*g* is fixed to the box body 6.

It is noted that, although this embodiment has the cover 7 locked to the box body 6 by directly locking the cover 7 by the locking piece 19*e* of the lock 19, another structure also may be employed in which the box 2 has a movable member that enables a locking position and a lock cancellation position of the cover 7 so that the lock 19 can be used to lock the movable member to the locking position to indirectly lock the cover 7 to the box body 6. Although this embodiment has locked the cover 7 to the box body 6 by inserting the locking piece 19*f* also into a long hole (not shown)of the upper wall of the box body 6, another structure also may be used in which the locking piece 19*e* is merely inserted into the long hole 12 of the cover 7. Alternatively, another structure also may be used in which, in order to insert the locking piece 19*f* also into a long hole (not shown) of the upper wall 6*b* of the box body 6, two upper walls 6*b* are provided at the upper and lower sides so that the locking piece 19*f* can be inserted into the long hole of the lower upper wall or the lower side of the upper wall 6*b* also may have a locking member including a long hole.

As shown in FIG. 2, the control panel 8*a* has an inverted L-like shape when seen from the front side. The control panel 8*a* is attached to the box body 6 in a detachable manner.

FIG. 2 shows the control panel 8*a* detached from the box body 6 and the front panel 8 of the box body 6 has a notch 20 having the same shape as that of the control panel 8*a*. Wall faces at both sides of the control panel 8*a* have concave grooves 23 arranged in the longitudinal direction with a predetermined interval. A wall face for separating the notch 20 in the box body 6 on the other hand has convex grooves 22 arranged in the longitudinal direction with an appropriate interval to the inner side of the width direction. In order to attach the control panel 8*a* to the box body 6, while the cover 7 is detached from the box body 6, the control panel 8*a* is engaged into the notch 20 from the front face side to slide the control panel 8*a* in the lower direction to engage the concave grooves 23 with the convex grooves 22 to attach the control panel 8*a* to a predetermined position of the box body 6. The control panel 8*a* can be detached from the box body 6 on the other hand in an opposite order of that of the above operation. It is noted that the control panel 8*a* includes a connector (not shown) that can be connected to a connector 6*c* at the box body 6. These connectors are automatically connected when the control panel 8*a* is attached to the box body 6 to electrically connect the side of the control panel 8*a* to the side of the box body 6.

As described above, the control panel 8*a* is formed separately from the box body 6 and the control panel 8*a* is structured so as to be detachable from the box body 6. This provides not only an easy maintenance of the control panel 8*a* and but also an easy maintenance of the interior of the box body 6.

Figure 6:
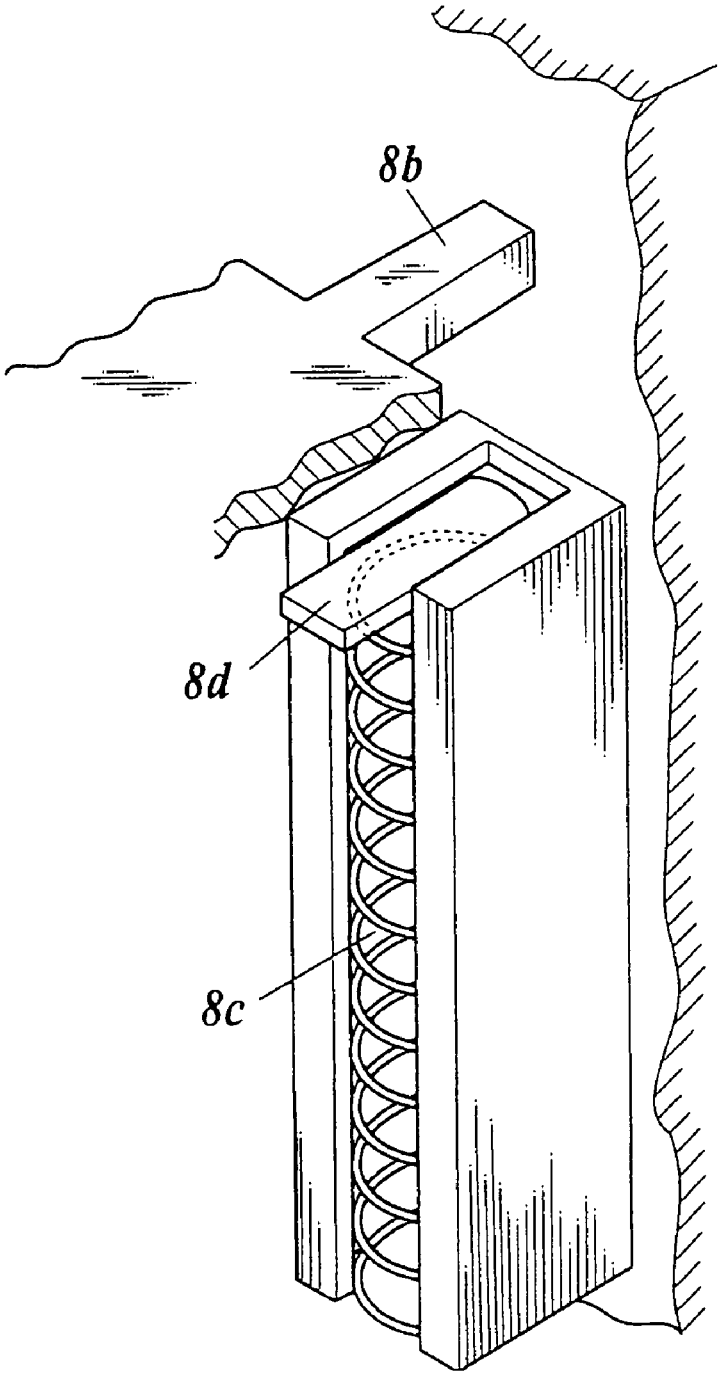
[FIG. 6] This is a perspective view illustrating a buffering section for preventing the control panel from being dropped.

It is noted that, as shown in FIG. 2 and FIG. 6, wall faces at the left and right sides of the control panel 8*a* have locking pieces 8*b* for retaining the control panel 8 a slight distance from the bottom of the notch 20. This locking piece 8*b* abuts a protrusion 8*d* that is provided at one wall face which forms a part of the notch 20 and is biased by a spring 8*c* while the control panel 8*a* is being retained to have a slight distance from the bottom of the notch 20. However, the retaining force by this locking piece 8*b* is not so high. Specifically, the biasing force of the spring 8*c* toward this locking piece is sufficient to support the weight of the control panel 8*a*. However, when the control panel 8*a* is manually depressed in the lower direction, the control panel 8*a* is moved downward against the biasing force. The structure as described above is provided for the purpose of preventing the control panel 8*a* from moving down when the control panel 8*a* is engaged into the box body 6 and for the purpose of allowing a coin collection box 21 (which will be described later) to be drawn while the control panel 8*a* is positioned to have a slight distance from the bottom of the notch 20.

Figure 7:
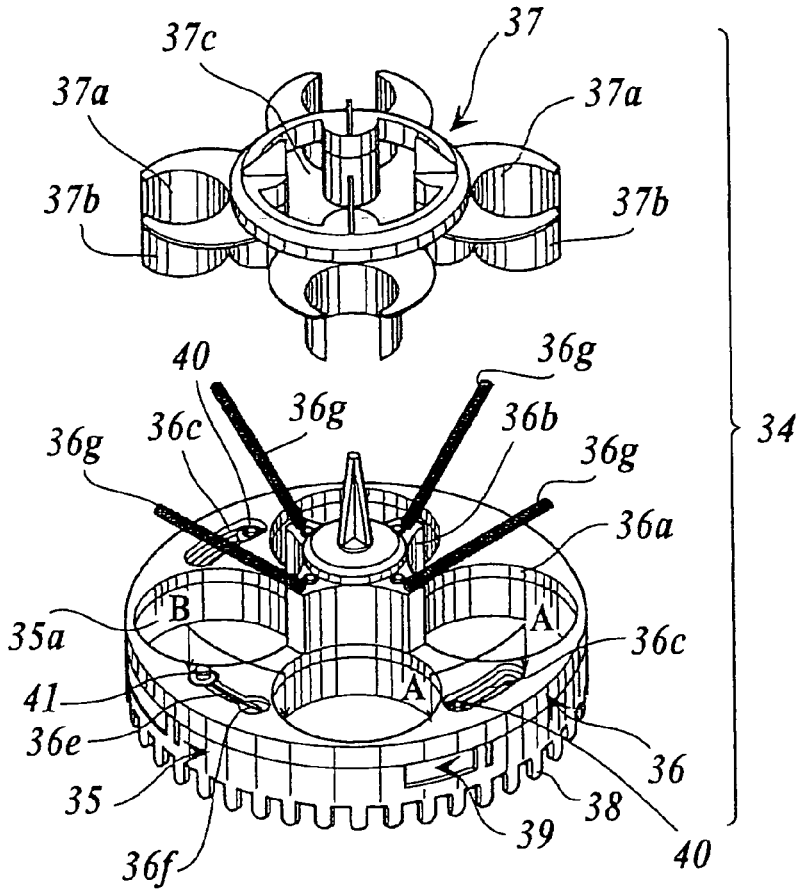
[FIG. 7] This is an exploded perspective view illustrating a partition plate and a discharge merchandise retention member.
Figure 7:
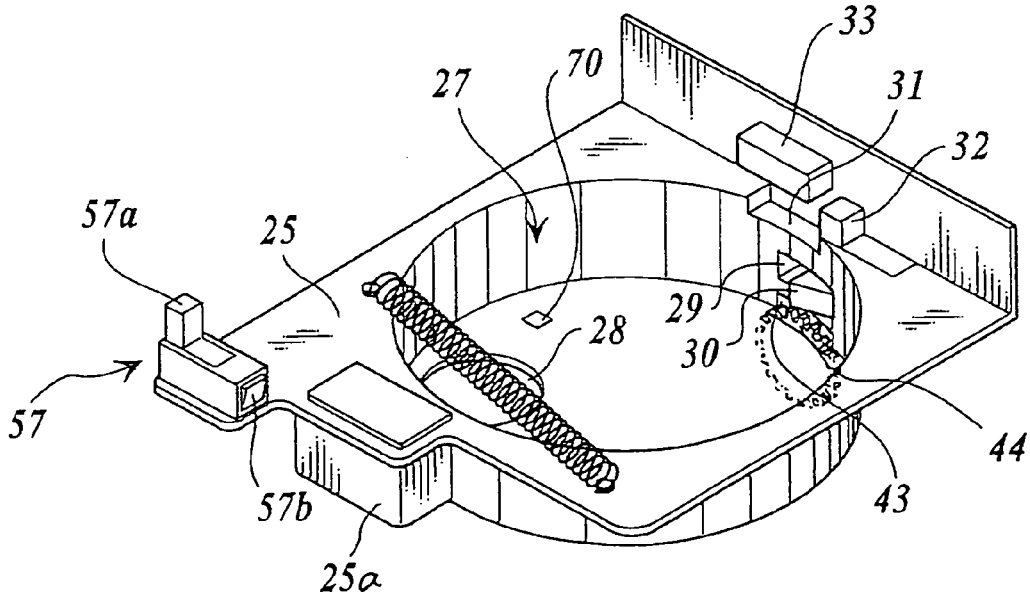

Next, a structure for fixing the control panel 8*a* will be described. As shown in FIG. 2, FIG. 4, FIG. 7, and FIG. 8, the control panel 8*a* and a partition plate 25 (which will be described later) respectively have a locking section 57 for locking the control panel 8*a* to the box body 6. The two sections 57 have the same structure and thus the locking section 57 provided at the partition plate 25 will be exemplarily described. As shown in FIG. 7, the locking section 57 includes a locking pin 57*b* that operates via the operation part 57*a*. When the control panel 8*a* is attached to the box body 6 and the operation part 57*a* of the locking section 57 is operated to protrude the locking pin 57*b*, the locking pin 57*b* is positioned at the upper side of the control panel 8*a*. This locking section 57 prevents the upward movement of the control panel 8*a*. The locking section 57 provided at the control panel 8*a* on the other hand causes the locking pin 57*b* protruded by the operation of the operation part 57*a* to be engaged with a concave part (not shown) provided in the box body 6.

It is noted that the locking section 57 is not always required to be provided. The reason is that, by attaching the control panel 8*a* and subsequently attaching the cover 7 to fix the cover 7 to the box body 6 by rotating the key 19*b*, the upward movement of the control panel 8*a* is regulated by the cover 7 to prevent the control panel 8*a* from being detached. However, the existence of the locking section 57 can allow the control panel 8*a* to be more firmly fixed to the box body 6.

As shown in FIG. 4, the box body 6 includes therein the partition plate 25 for partitioning the box body 6 to upper and lower parts. The upper part of this partition plate 25 functions as a merchandise storage space 26. The partition plate 25 has a circular concave part 27 as shown in FIG. 4 and FIG. 7. The bottom part of the concave part 27 has one merchandise discharge hole 28. A discharged article retention member 34 is placed in the concave part 27. The bottom part of the concave part 27 also has a next merchandise detection section 70 (which will be described later). The bottom part of the concave part 27 also has a rectangular hole 43 for exposing a gear 44.

As shown in FIG. 7, the discharge merchandise retention member 34 is composed of a drum 35 and an adapter 37. It is noted that the drum 35 may not always have a regulation plate The drum 35 has a plurality of merchandise retention holes 35*a* (four merchandise retention holes 35*a* in this embodiment) that retain a merchandise having a relatively large diameter (e.g., a merchandise filled in a capsule) and that are provided in the circumference direction with an identical interval. Furthermore, the drum 35 includes rack teeth 38 at the circumference edge of the lower face. Thus, when the drum 35 is placed on the concave part 27, the rack teeth 38 are meshed with the gear 44. As shown in FIG. 4, the gear 44 is connected to the handle 4 via an axis 45, the gears 24 and 46, and an axis 4*a*. Thus, when the handle 4 is rotated, the rotation power of the handle 4 is transmitted to the drum 35 via the axis 4*a*, the gears 24 and 46, the axis 45, and the gear 44, and the rack teeth 38, thereby rotating the drum 35. In this case, one rotation of the handle 4 causes the rotation of the drum 35 in an amount of 360 degrees/(the number of the merchandise retention holes 35*a*). Thus, whenever one rotation of the handle 4 is caused, the merchandise retention hole 35*a* matches the merchandise discharge hole 28 and thus merchandises retained at the merchandise retention hole 35*a* are discharged one by one.

The circumference face of the drum 35 has a concave part 39 having the same function as that of ratchet teeth. On the other hand, a part of the circumference wall forming the concave part 27 has a rectangular hole 29. The rectangular hole 29 has a ratchet piece 30 that has the same function as that of a ratchet nail and that is provided in a retractable manner. This ratchet piece 30 is biased in a protrusion direction by a spring (not shown) and the concave part 39 of the drum 35 is engaged with the ratchet piece 30 so that the ratchet piece 30 prevents the inverse rotation of the drum 35.

The drum 35 includes the regulation plate 36. The regulation plate 36 is provided on the drum body. The regulation plate 36 is structured to be rotatable around the axis center of the drum 35 in a predetermined angle range. This regulation plate 36 has holes 36*a* in the circumference direction that have the same shapes as those of the merchandise retention holes 35*a* and that are provided in the same number and pitch of the merchandise retention holes 35*a*. The hole 36*a* of the regulation plate 36 functions to change, in accordance with the rotation amount of the regulation plate 36, the diameter of the merchandise retention hole 35*a*. Furthermore, a rib 36*b*, for guiding the merchandise at the upper part to the outer side of the radius direction of the drum 35, is disposed upright in the center of the regulation plate 36. Furthermore, in order to mix merchandises at the upper side of the drum 35 the rib 36*b* has four springs 36*g* that are arranged to the outer side in an oblique upward direction.

Figure 9:
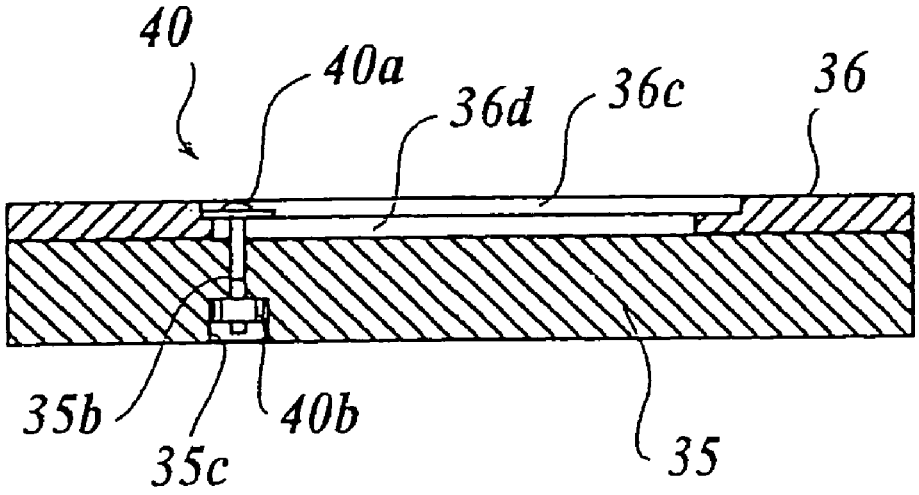
[FIG. 9] This is a view illustrating a structure in which a drum body is attached with a regulation plate.

Next, a structure for attaching the regulation plate 36 will be described. As shown in FIG. 7 and FIG. 9, the drum 35 and the regulation plate 36 are mutually attached by a screw 40. Specifically, the drum body has an insertion hole 35*b* to which the axis of a male screw 40*a* is inserted and a counterbore 35*c* receiving a nut 40*b*. On the other hand, the regulation plate 36 has a circular arc-like insertion hole 36*d* that receives the axis of the male screw 40*a* and that allows the regulation plate 36 to rotate to the drum body; and a circular arc-like counterbore 36*c* that receives the head and washer of the male screw 40*a* and that allows the regulation plate 36 to rotate to the drum body.

Figure 10:
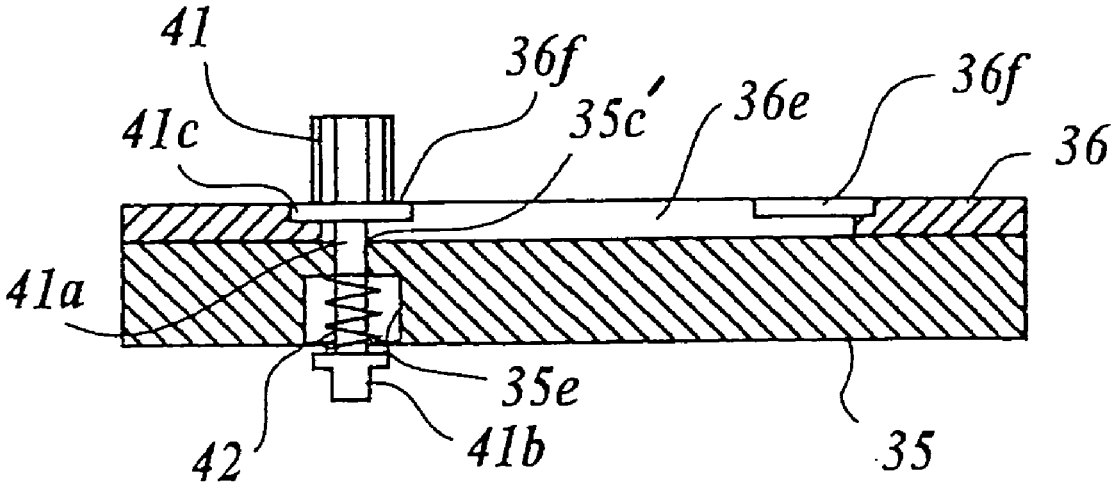
[FIG. 10] This is a view illustrating an adjustment mechanism of a merchandise retention hole.

Next, a merchandise retention hole adjustment mechanism will be described. As shown in FIG. 10, the drum body includes an insertion hole 35*c*', i.e., in which an axis 41*a* of a knob part 41 is inserted; and a counterbore 35*e* receiving a coil spring 42 for biasing downward a nut 41*b* screwed onto a lower end of the axis 41*a* of the knob part 41. On the other hand, the regulation plate 36 has a circular arc-like insertion hole 36*e* that is inserted with the axis 41*a* of the knob part 41; and that allows the regulation plate 36 to rotate to the drum body and counterbores 36*f* that are provided at both ends of the circular arc-like insertion hole 36*e* and that receive a guard 41*c* of the knob part 41.

Next, a method for adjusting the merchandise retention holes 35*a* by the regulation plate 36 will be described. When the guard 41*c* of the knob part 41 is received by one of the counterbores 36*f*, the merchandise retention hole 35*a* of the drum 35 matches the hole 36*a* of the regulation plate 36, thereby allowing a merchandise having the maximum diameter to pass therethrough. When the guard 41*c* of the knob part 41 is received by the other of the counterbores 36*f* on the other hand, the merchandise retention hole 35*a* of the drum 35 is partially superposed on the hole 36*a* of the regulation plate 36, thereby allowing only a small merchandise to pass therethrough.

In order to move the position of the knob part 41 from one of the counterbores 36*f* to the other of the counterbores 36*f*, the knob part 41 is raised against the biasing force of the coil spring 42 and the guard 41*c* is once disengaged from the counterbore 36*f*. In this status, the regulation plate 36 is rotated relative to the drum body in one direction so that the knob part 41 is moved along the insertion hole 36*e* to insert the guard 41*c* in the other counterbore 36*f*.

Figure 8:
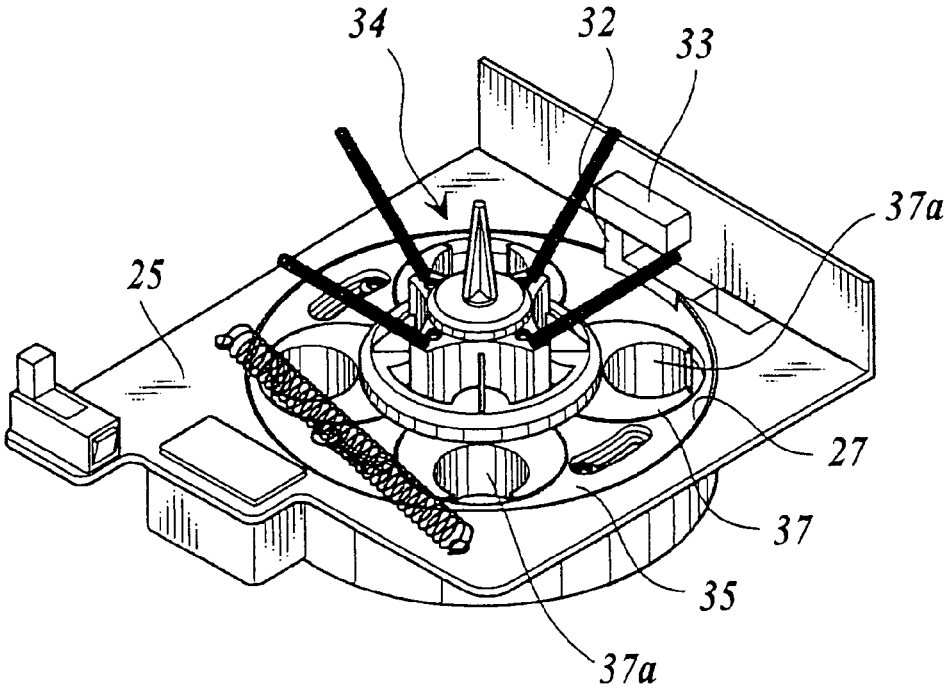
[FIG. 8] This is a perspective view illustrating how a drum attached with an adapter is placed.

The adapter 37 can be attached to or detached from the drum 35. As shown in FIG. 7, the adapter 37 is structured so that merchandise retention holes 37*a* are provided in the periphery direction with an identical interval and in the same quantity as that of the merchandise retention holes 35*a*. The merchandise retention holes 37*a* have a smaller diameter than that of the merchandise retention holes 35*a* and are shaped so that the outer periphery is partially cut out. This adapter 37 can be attached to the drum 35 by bundling, while causing the merchandise retention hole 35*a* of the drum 35 to match the hole 36*a* of the regulation plate 36, the springs 36*g* at the upper part of the drum 35 to insert the bundled springs 36*g* into the hole 37*c* at the center of the adapter 37 from the lower side and by externally engaging the hole 37*c* with the rib 36*b*, thereby allowing circular cylindrical sections 37*b* at the lower face of the adapter 37 to be received by the merchandise retention holes 35*a*. Then, as shown in FIG. 8, the article retention holes 37*a* of the adapter 37 and the edges thereof are engaged with the article retention holes 35*a*. This adapter 37 can be applied to a merchandise having a further smaller diameter than in the case where the regulation plate 36 is used.

As shown in FIG. 7, the upper edge of the concave part 27 has a notch 31. This notch 31 has a locking piece 32 provided in a projectable manner. At the upper part of a moving range of the locking piece, a guide piece 33 is provided that regulates the upward displacement of the locking piece 32. This locking piece 32 is protruded to the upper face of the drum 35 while the drum 35 being placed on the concave part 27 to restrict the drum 35 in the concave part 27 as shown in FIG. 8. On the other hand, when the locking piece 32 is retracted from the upper face of the drum 35, the restriction of the drum 35 is cancelled, thereby detaching the drum 35 from the concave part 27.

As shown in FIG. 2 and FIG. 4, the box body 6 has therein a guide plate 47. The guide plate 47 is formed to have a bent shape. The lower end of this guide plate 47 is attached via a coil spring 49 to the partition plate 25. A raised part of the upper end of the guide plate 47 on the other hand has a concave part 47*a* that has an opening to the inner side. This concave part 47*a* is engaged with a protrusion 48 provided at the inner face of both walls at the sides of the merchandise filling opening 6*a*. When this concave part 47*a* is engaged with the protrusion 48, the guide plate 47 is retained while being inclined from the intermediate part of the merchandise filling opening 6*a* to the partition plate 25. When the engagement of the concave part 47*a* and the protrusion 48 is cancelled, the guide plate 47 can be inclined to the front side to expand the merchandise filling opening 6*a*. Thus, merchandises can be filled and the interior of the box body 6 can be subjected to a maintenance operation in an easier manner.

Figure 11A:
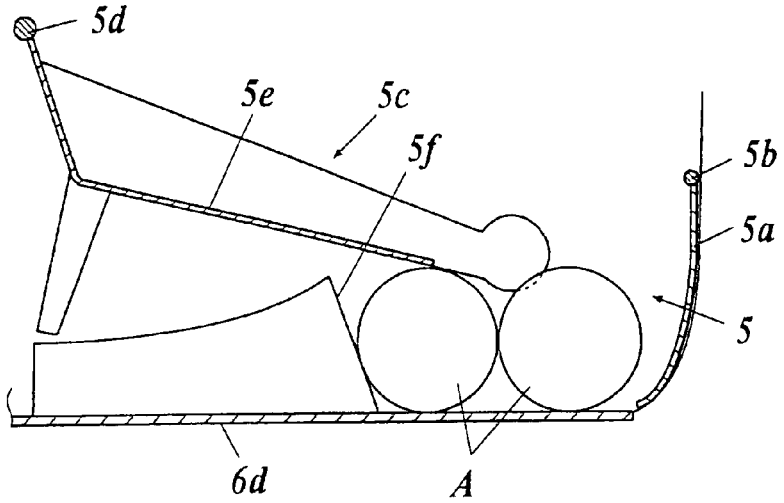
[FIG. 11A] This is a view illustrating the normal status of a cover for opening or closing the merchandise discharge opening.
Figure 11B:
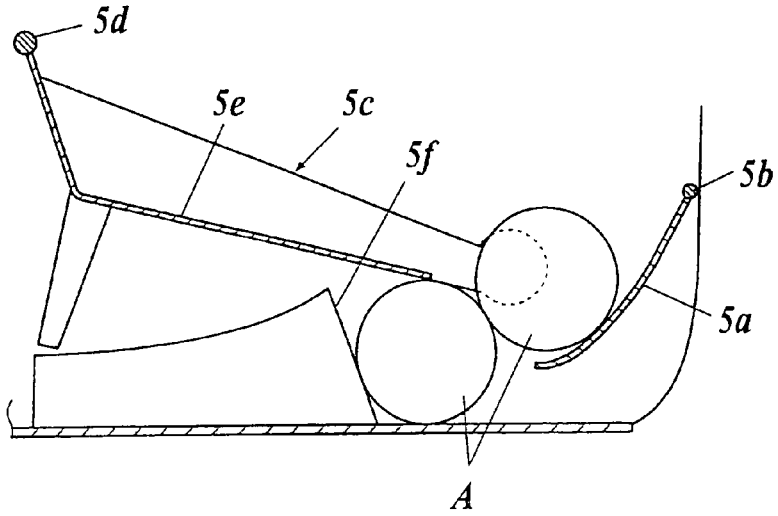
Figure 11C:
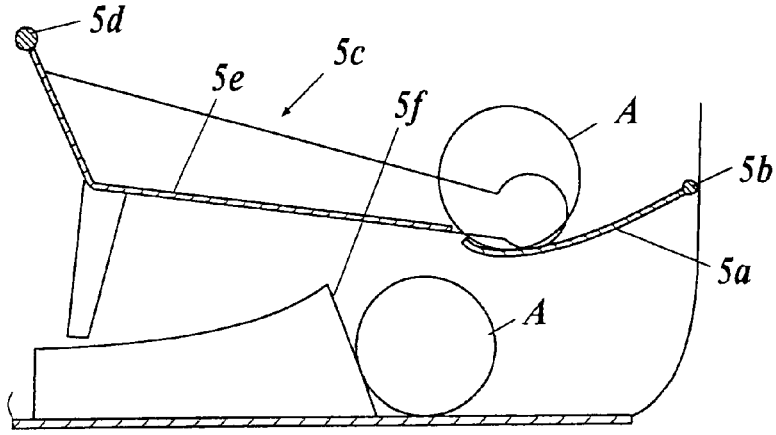

FIGS. 11A-11C illustrates the inner structure of the merchandise discharge opening 5. The front panel 8 of the box body 6 has a cover 5*a* for opening or closing the merchandise discharge opening 5. This cover 5*a* is attached to the front panel 8 so as to be rotatable around the axis 5*b*. The cover 5*a* is structured so that the cover 5*a* is rotated to the inner side of the box body 6. At the inner side of the cover 5*a* in the box body 6, a discharge mechanism for the capsule merchandise A is provided. This discharge mechanism includes a stopper 5*f* provided at a bottom wall 6*d* and a shooter 5*c* provided at the upper side of the stopper 5*f*. Among them, the shooter 5*c* is attached to the box body 6 so as to be rotatable around the axis 5*d*. This shooter 5*c* has a substantially L-like bottom wall 5*e*. Thus, the shooter 5*c* receives the capsule merchandise A dropped from the merchandise discharge hole 28 provided at the concave part 27 of the partition plate 25 at the lower side and guides it to the merchandise discharge opening 5.

As shown in FIG. 11A, a depth dimension from the cover 5*a* to the stopper 5*f* is determined so that two capsule merchandises A can be housed in the article discharge opening 5. Furthermore, the merchandise discharge opening 5 has a width that is determined so that one capsule merchandise A can be housed therein. When the cover 5*a* is rotated to the inner side after two capsule merchandises A are accumulated in the merchandise discharge opening 5, the front capsule merchandise A is scooped by the cover 5*a* as shown in FIG. 11(B). Then, as shown in FIG. 11(*c*), the tip end of the side wall of the shooter 5*c* abuts the cover 5*a* in the middle of scooping the capsule merchandise A so that the tip end and the cover 5*a* cooperatively scoop the capsule merchandise A, thereby completely releasing the merchandise discharge opening 5. Then, the capsule merchandise A existing on the bottom wall 6*d* is taken out. Next, when the cover 5*a* is once closed, the previously-scooped capsule merchandise A drops from the cover 5*a*. Thus, the capsule merchandise A can be taken out by reopening the cover 5*a*. This merchandise discharge mechanism can allow, even when the status as shown in FIG. 11(A) (i.e., when a plurality of capsule merchandises A exist) is caused, the cover 5*a* to be securely opened, thus allowing the merchandises to be securely taken out.

It is noted that, although the above embodiment has provided the lower part of the cover 5*a* curved to the inner side of the case body, the same function provided by the inwardly-curved cover 5*a* also can be provided by another structure in which the inner face of the cover 5*a* has a rib (e.g., a protrusion such as a protruded piece) and the inner face of the rib is curved or the rib includes a hook.

As shown in FIG. 2 and FIG. 4, the bottom of the box body 6 at the rear side of the notch 20 has a coin collection box 21. The coin collection box 21 can be detached from the box body 6 by being pulled to the front side. This coin collection box 21 can be fixed to the box body 6 by the lock 21*a*. This coin collection box 21 can be attached to or detached from the box body 6 when the control panel 8*a* is slight distance from the bottom of the box body 6 or when the control panel 8*a* is completely detached from the box body 6.

It is noted that, when the control panel 8*a* is attached, the coin collection box 21 attached to the box body 6 is completely covered and cannot be visually recognized from the front side.

FIG. 1 illustrates the top panel 10 attached to the box body 6. FIG. 2 illustrates the top panel 10 detached from the box body 6. It is noted that FIG. 2 shows the top panel 10 in a reversed manner. The lower face of this top panel 10 has a tongue piece (insertion section) 53 extending in a lower direction. The tip end of the tongue piece has a hole (locking hole) 54. The upper wall 6*b* with which the top panel 10 is attached on the other hand has a rectangular hole (insertion hole) 52 for example. By inserting the tongue piece 53 of the top panel 10 to the hole 52 of the upper wall 6*b*, the top panel 10 is placed on the box body 6.

Figure 12:
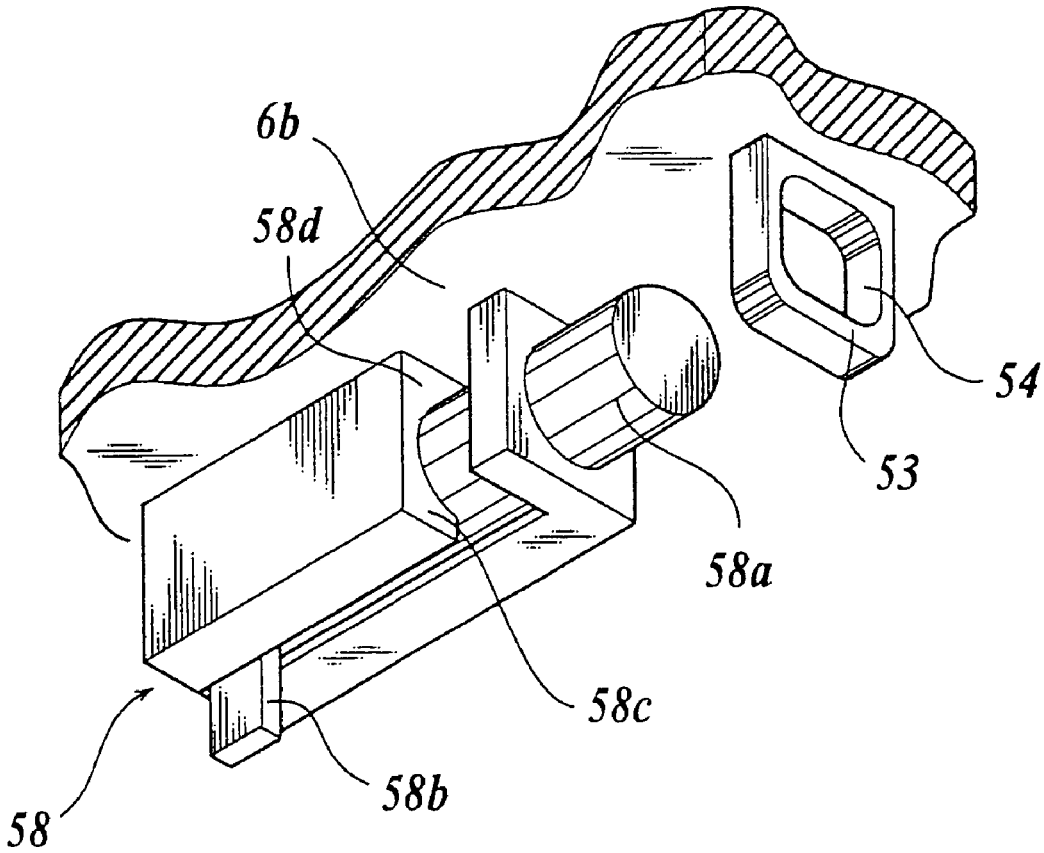
[FIG. 12] This is a view illustrating a structure for attaching a top panel.

Furthermore, the locking member 58 is attached with the upper wall 6*b* of the box body 6. This locking member 58 can be inserted to or detached from the hole 54 of the tongue piece 53 inserted to the hole 52. Specifically, as shown in FIG. 12, a locking member body 58*d* receives a shank 58*a* with an operation part 58*b* attached thereto. This locking member 58 is attached to the box body 6 so as to be able to reciprocate in orthogonal direction relative to the insertion direction of the tongue piece 53 of the top panel 10. In this case, the operation direction matches the axial direction of the shank 53*a*. Furthermore, the locking member 58 can be rotated around the axis line of the shank 58*a* while the shank 58*a* is inserted in the hole 54. When the locking member 58 is rotated in one direction while the shank 58*a* is inserted into the hole 54, the operation part 58*b* is locked to a lock part 58*c* to prevent the locking member 58 from being moved in the axis line direction. Thus, the locking member 58 is locked.

The structure for attaching the top panel 10 as described above provides the following advantages. Specifically, although this embodiment has two boxes 2 stacked in the longitudinal direction, the lower face of the upper box 2 can have the same tongue piece 53 as that as in the top panel 10 to easily stack the boxes 2 as in the attachment of the top panel 10. Alternatively, by providing the tongue piece 53 as in the top panel 10 not only at the box 2 but also at the lower face of the display box, a display box (display case) can be easily provided as in the attachment of the top panel 10. The box 2 of the vending machine 1 includes the control panel 8*a* or the display section 17 for example and thus the interior is not easily visually recognized. However, the use of the display box can display merchandises therein and thus a purchaser can know the merchandises stored in the vending machine 1.

Figure 13:
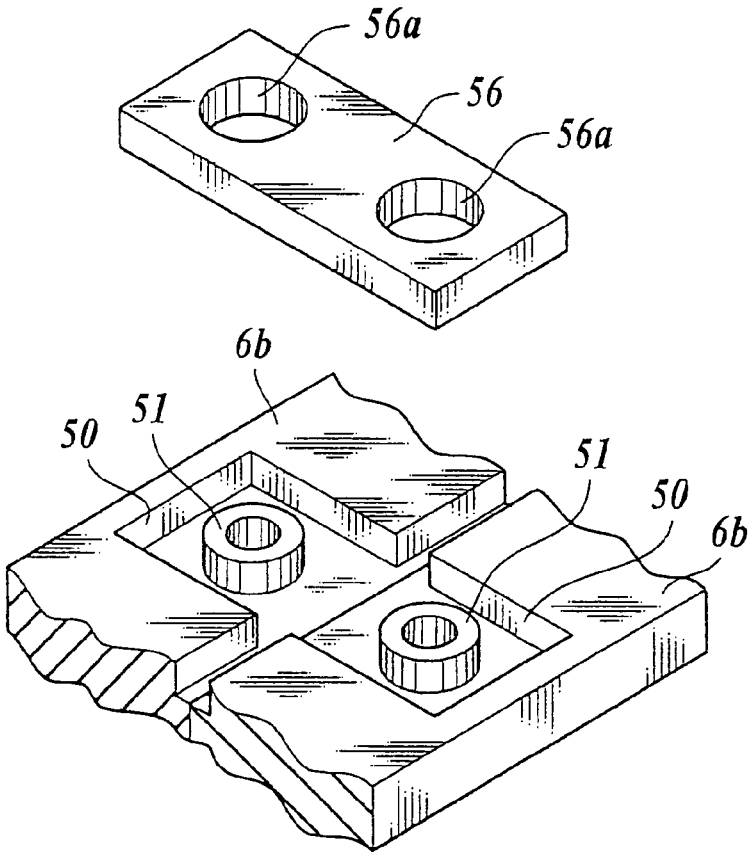
[FIG. 13] This is an exploded perspective view illustrating a case where box bodies are connected while the box bodies being arranged to be adjacent to each other.
Figure 14:
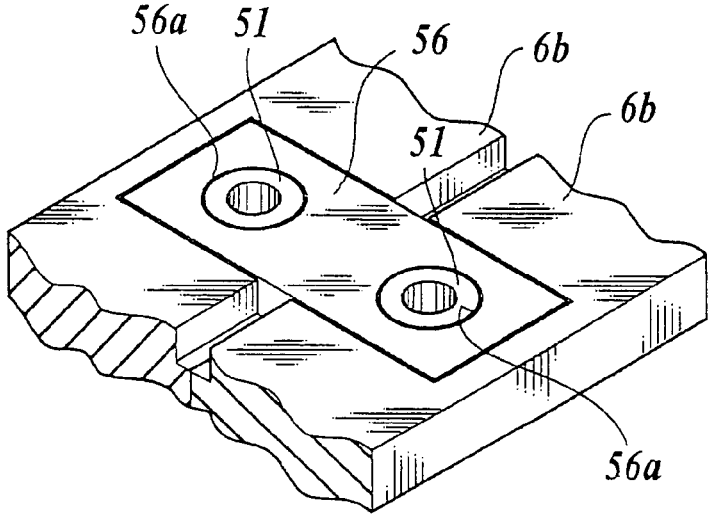
[FIG. 14] This is a perspective view illustrating box bodies connected while the box bodies being arranged to be adjacent to each other.

The vending machine 1 includes a connection block 56 as shown in FIG. 2, FIG. 13, and FIG. 14. The connection block 56 has two holes (engagement sections) 56*a*. When two vending machines 1 are aligned and are connected to each other, the holes 56*a* of the connection blocks 56 are respectively engaged with the notches 50 of the box bodies 6 and are engaged with bosses (engagement sections) 51 of the box body 6 and are subsequently attached with the top panels 10.

When one vending machine 1 is used separately, a block 55 having one hole 55*a* can be engaged with the boss 51 of the box body 6 to cover the notch 10*a* of the end plate 10.

When the blocks 55 and 56 are not used, the blocks 55 and 56 are stored by engaging the holes 55*a* and 56*a* with the bosses 10*b* disposed upright in the back face of the top panel 10 or with the ribs 10C disposed upright in the back face of the top panel 10.

It is noted that, when neighboring vending machines 1 are connected by the connection block 56, the stands thereof are also preferably connected. In this case, the stands are connected by a clip that can simultaneously sandwich the side walls of the stands for example.

Figure 15:
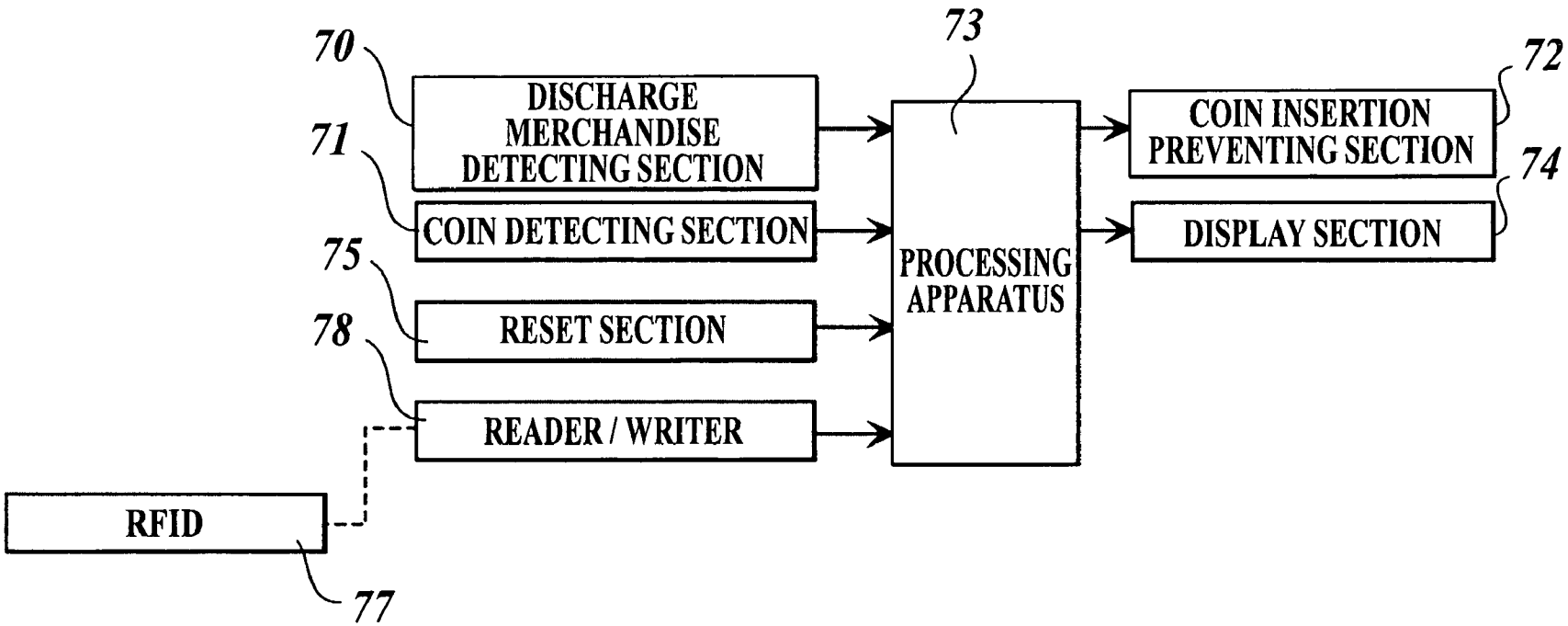
[FIG. 15] This is a block diagram illustrating the structure of an internal circuit.

As shown in FIG. 15, the vending machine 1 includes: the discharge merchandise detection section 70 for detecting a discharged merchandise and outputting a detection signal; a coin detecting section 71 for detecting whether inserted coins are full or not and outputting a detection signal; a display section 74 for displaying the total number of discharged merchandises and some other content; a processing apparatus 73 for controlling the coin insertion preventing section 72 based on the detection signals outputted from the discharge merchandise detection section 70 and the coin detecting section 71 and for calculating, based on the detection signal outputted from the discharge merchandise detection section 70, the total number of the discharged merchandises to cause the display section 74 to display the number, and a reset section 75.

The discharge merchandise detection section 70 is composed of a photosensor and so forth. The discharge merchandise detection section 70 is provided at the bottom part of the concave part 27 as described above. The discharge merchandise detection section 70 is currently positioned so as not to match the merchandise discharge hole 28 but the position thereof matches the position just below the merchandise retention hole 35*a* that matches the merchandise discharge hole 28 when the drum 35 is rotated in accordance with the subsequent rotation of the handle 4. Hereinafter, the merchandise retention hole 35*a* at this position will be described as the next merchandise retention hole 35*a*. By retaining a merchandise at the next merchandise retention hole 35*a*, the merchandise is securely discharged when the drum 35 is rotated in accordance with the next rotation of the handle 4 and the next merchandise retention hole 35*a* matches the merchandise discharge hole 28. Thus, the processing apparatus 73 can calculate the total number of discharged merchandises by detecting whether the merchandise is retained at the next merchandise retention hole 35*a* or not whenever the handle 4 is rotated. When the next merchandise retention hole 35*a* does not retain a merchandise, this means that no merchandise is discharged when the drum 35 is rotated in accordance with the next rotation of the handle 4. Thus, in order to prevent a discharge failure of a merchandise, the processing apparatus 73 controls a coin insertion preventing section 72 to prevent the insertion of a coin.

It is noted that another configuration also may be used in which, in addition to the discharge merchandise detection section 70 for detecting the next discharge merchandise to prevent a discharge failure of a merchandise, an additional discharge merchandise detection section is provided to detect a merchandise that passes through the merchandise discharge hole 28 and that is actually discharged, or to detect the rotation of the drum 35 to calculate the number of discharged merchandises based on this detection signal. As shown in FIG. 7, in this embodiment, a pocket 25*a* having a cover is provided in order to attach a discharge merchandise detection section that abuts the circumference face of the drum 35 by a spring and that has a protrusion slid while abutting the circumference face of the drum 35 in accordance with the rotation of the drum 35.

The display section 74 is composed of a liquid crystal display section for example. The display section 74 is structured so that, when a Radio Frequency Identification (REID) 77 is moved close to a predetermined position of the control panel 8*a*, a reader 78 reads the ID of the REID 77. When the ID matches the vending machine 1, the processing apparatus 73 causes the display section 74 to display the total number of discharged merchandises for a predetermined time (e.g., 30 seconds). It is noted that the display section 74 also can display content other than the total number of discharged merchandises. For example, a rotation detection section for detecting the rotation of the handle 4 also can be additionally provided so as to display, a predetermined video or today's fortune or example when the handle 4 is rotated. When the next merchandise is not available, "SOLDOUT" also can be displayed. When moving the RFID 77 closer to a predetermined position of the control panel 8*a* to cause the display section 74 to display the total number of discharged merchandises, in adding to this an activation of another switch may also be necessitated. For example, a switch also may provided in the merchandise discharge opening 5 so that the switch is turned ON when the switch abuts the cover 5*a* when the cover 5*a* is rotated to the inner side for a more-then-required distance (i.e., than a distance required for taking a merchandise out of the vending machine).

The reset section 75 is provided at the back side of the control panel 8*a* so as not to be operable at the outer side of the box body 6. When this reset section 75 is operated, the total number of discharged merchandises that has been counted and stored in the storage section of the processing apparatus 73 is reset. Then, the processing apparatus 73 counts the total number of discharged merchandises from the point at which the reset section 75 is operated.

Figure 16:
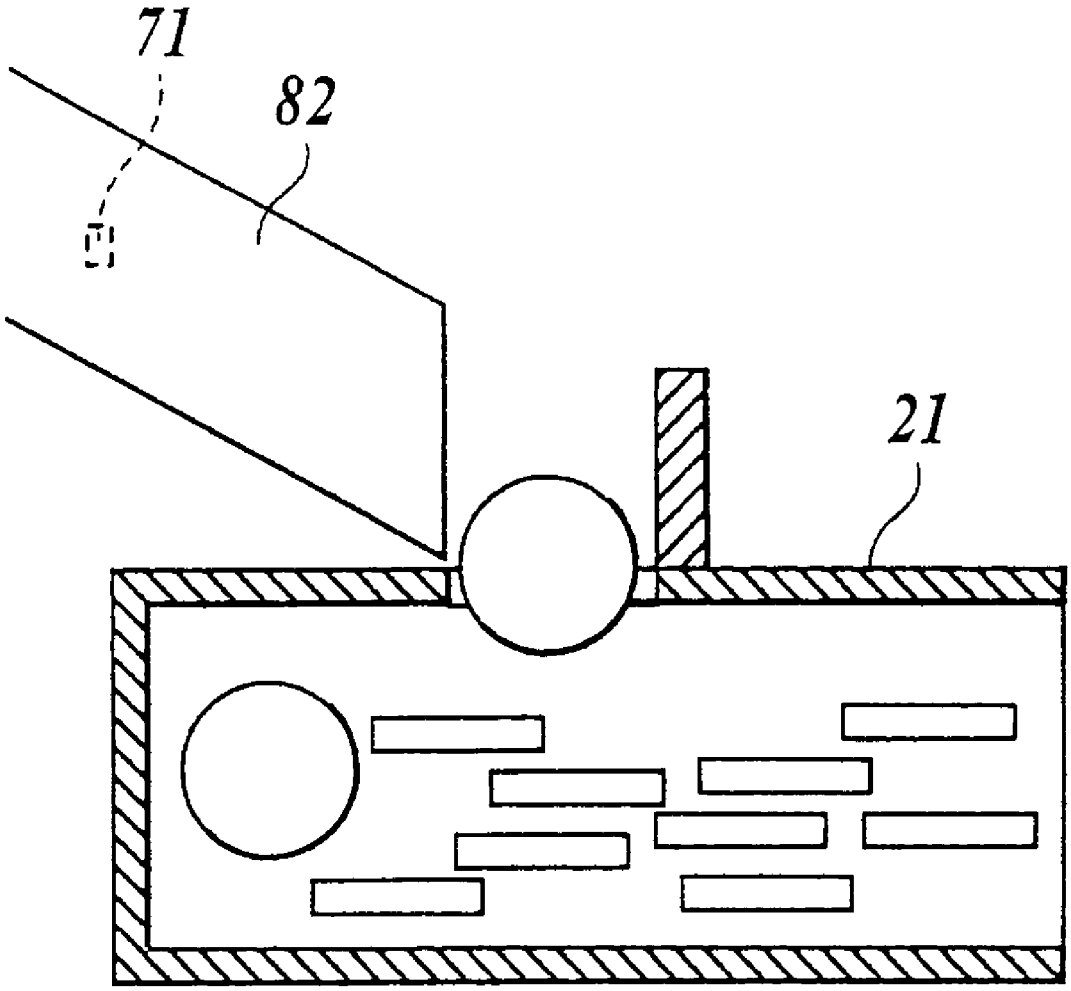
[FIG. 16] This is a view illustrating an example of a position at which a coin detecting section is attached.

The coin detecting section 71 is composed of a photosensor and so forth. As shown in FIG. 16, the coin detecting section 71 is provided in a coin guide route, which is provided at the control panel 8*a*, for guiding a coin into the coin collection box 21. The coin detecting section 71 detects whether coins are retained in the coin guide route or not. When coins are retained in the coin guide route, this coin detecting section 71 outputs to the processing apparatus 73 a signal showing full of coins. Upon receiving the signal, the processing apparatus 73 controls the coin insertion preventing section 72 to prevent the insertion of coins.

Figure 17A:
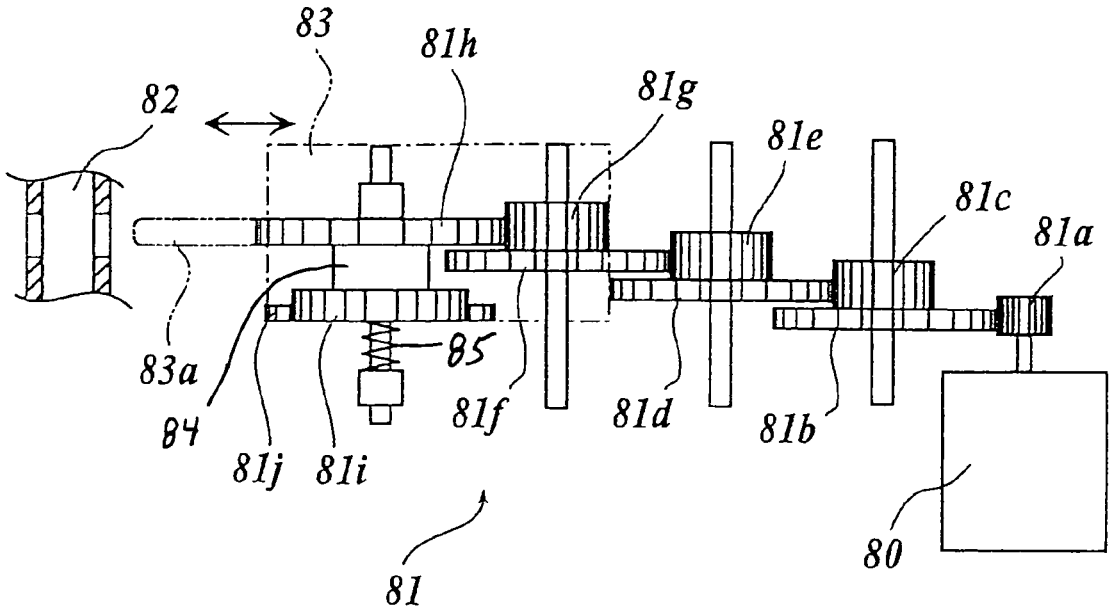
[FIG. 17A] This is a top view illustrating the structure of a coin insertion preventing section.
Figure 17B:
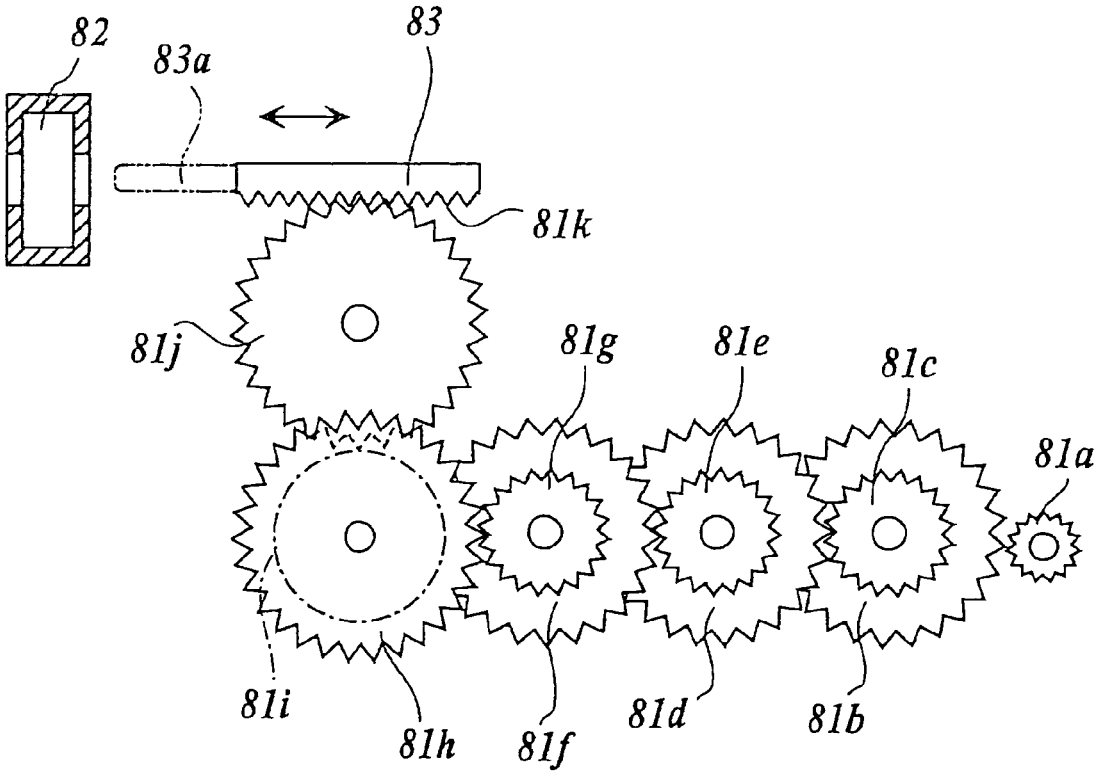
[FIG. 17B] This is a back view illustrating the structure of the coin insertion preventing section.

As shown in FIGS. 17A and 17B, the coin insertion preventing section 72 is structured to include: a motor 80; a gear mechanism 81 operated by the motor 80; and a projection 83*a* that is operated by the gear mechanism 81 to block a coin route 82. The gear mechanism 81 is composed of gears 81*a* to 81*j* and rack teeth 81*k*. The motor power is transmitted, through the gears 81*a* to 81*j* and the rack teeth 81*k*, to a rack member 83 and the projection 83*a* provided in the rack member 83 protrudes in the coin route 82 to block the coin route 82, thereby preventing the insertion of coins. When the reset section 75 is operated, the motor 80 is rotated in an inverse direction and the projection 83*a* is retracted from the coin route 82, thereby allowing the insertion of a coin again. It is noted that the reference numeral 84 in FIG. 17A represents a clutch and the gear 81*i* is pushed toward the gear 81*h* by a biasing force by the coil spring 85 to cause the gear 81*i* and the gear 81*h* to be rotated in an integrated manner. When an excessive load is applied to the gear 81*i*, the gear 81*i* is moved away from the gear 81*h* against the biasing force by the coil spring 85, thereby cancelling the connection between the projection 83*a*-side components and the motor 80-side components.

As described above, an embodiment of the present invention has been described. However, the present invention is not limited to this embodiment and also can be subjected to various modifications within a scope of the intention of the invention.

For example, another structure also may be used by which merchandises can be controlled by storing merchandise data (e.g., the total number of discharged merchandises) in an RFID semiconductor memory provided in the box 2 so that an external reader can be used to read the merchandise data (e.g., the total number of discharged merchandises) stored in the semiconductor memory. For example, the discharge merchandise detection section also can be used to detect discharged merchandises and the total number of discharged merchandises calculated based on the detection signals from the discharge merchandise detection section can be stored in the semiconductor memory. In this case, instead of causing the calculation result by the processing apparatus to be stored in the semiconductor memory, another structure also may be used in which another counting unit is provided. Merchandise data also may be the one regarding the time at which a merchandise is sold.

In the above embodiment, an attachment box 47*b* is provided at the back side of the raised part of the upper end of the guide plate 47 as shown in FIG. 4 so that this RFID can be attached at a later stage.

The invention of the present application can be preferably used for a vending machine that requires a maintenance operation of a coin sorting unit for example.

The invention claimed is:

1. A vending machine in which a coin is inserted and a handle operates a discharge merchandise retention member, so as to discharge merchandise, comprising:

an opening provided at a front face of a box body and extending upward;

a control panel detachably received in the opening, the control panel including the handle and a coin sorting unit, and being movable between a first lower position and a second, upper position; and a coin collection box removably received in the box body to receive coins from the coin sorting unit, said coin collection box having a first end adjacent the opening and a second, opposite end, wherein, when the control panel is in the first, lower position, the first end of the coin collection box is covered with the control panel, but when the control panel is in the second, upper position, the first end of the coin collection box is accessible from, and can be at least partially removed from, the box body;

a merchandise filling opening formed in the front face of the box body, in an upper portion of the opening;

a cover detachably connected to the box body to be movable between a first position covering the merchandise filling opening on the front face of the box body, and a second position removed from the box body, herein the control panel is prevented from moving into the second, upper position, when the cover is in the first, covering position, but the control panel is allowed to move into the second, upper position, when the cover is in the second, removed position.

2. The vending machine as claimed in claim 1, wherein a side of the opening has one of a projection or a recess, a side of the control panel has the other of a projection or a recess, and the control panel is attached to the box body by sliding the side of the control panel along an edge of the opening from the upper portion of the opening so that the recess receives the projection.

3. The vending machine as claimed in claim 1, wherein one of the control panel and the box body has a spring allowing the control panel to be movable between the first, lower and second, upper positions under a biasing force of the spring, and the control panel and the box body each have a locking section that prevents the control panel from moving against the biasing force of the spring.

4. The vending machine as claimed in claim 1, further comprising a lock to lock the cover to the box body when the cover is in the first position.

* * * * *

UNITED STATES PATENT AND TRADEMARK OFFICE

CERTIFICATE OF CORRECTION

PATENT NO. : 7,748,513 B2
APPLICATION NO. : 11/792383
DATED : July 6, 2010
INVENTOR(S) : Junichi Atsuta et al.

It is certified that error appears in the above-identified patent and that said Letters Patent is hereby corrected as shown below:

Title page, Abstract, line 1, delete "merchandises" and insert --merchandise--;

Column 14, line 21, delete "herein" and insert --wherein--.

Signed and Sealed this

Sixteenth Day of November, 2010

David J. Kappos

David J. Kappos
*Director of the United States Patent and Trademark Office*